US010730325B2

(12) United States Patent
Kobayashi

(10) Patent No.: US 10,730,325 B2
(45) Date of Patent: Aug. 4, 2020

(54) LIQUID EJECTING APPARATUS AND ADJUSTMENT PART

(71) Applicant: SEIKO EPSON CORPORATION, Tokyo (JP)

(72) Inventor: Takahiro Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/298,034

(22) Filed: Mar. 11, 2019

(65) Prior Publication Data

US 2019/0283473 A1 Sep. 19, 2019

(30) Foreign Application Priority Data

Mar. 13, 2018 (JP) ..... 2018-045548

(51) Int. Cl.

| | |
|---|---|
| ***B41J 25/00*** | (2006.01) |
| ***B41J 19/00*** | (2006.01) |
| ***B41J 2/21*** | (2006.01) |
| ***B41J 29/377*** | (2006.01) |
| *B41J 3/407* | (2006.01) |

(52) U.S. Cl.

CPC ..... *B41J 25/005* (2013.01); *B41J 2/2132* (2013.01); *B41J 19/00* (2013.01); *B41J 29/377* (2013.01); *B41J 3/4078* (2013.01)

(58) Field of Classification Search

CPC ..... B41J 25/005; B41J 29/377; B41J 2/2132; B41J 19/00; B41J 3/4078

See application file for complete search history.

(56) References Cited

U.S. PATENT DOCUMENTS

2003/0160852 A1* 8/2003 Pickup ..... B41J 11/002 347/102

FOREIGN PATENT DOCUMENTS

| | | |
|---|---|---|
| EP | 2857209 A | 4/2015 |
| EP | 3192659 A | 7/2017 |
| JP | 2015-067931 | 4/2015 |

OTHER PUBLICATIONS

European Search Report issued in Application No. 19162640 dated Jul. 5, 2019.

* cited by examiner

*Primary Examiner* — Justin Seo

(74) *Attorney, Agent, or Firm* — Workman Nydegger

(57) ABSTRACT

A liquid ejecting apparatus includes a head that can eject liquid, a carriage that holds the head and can move in an intersecting direction, a support portion that can support a medium from a side opposite the side on which the head is located, a frame portion that is provided upstream of the carriage in the transport direction, the carriage being attached to the frame portion, a cover portion that covers the carriage, a first adjustment part that is attached to the frame portion, and a second adjustment part that is attached to a positioning portion. A difference between a first adjustment distance and a second adjustment distance is smaller than a difference between a first distance and a second distance.

7 Claims, 4 Drawing Sheets

LIQUID EJECTING APPARATUS AND ADJUSTMENT PART

BACKGROUND

1. Technical Field

The invention relates to a liquid ejecting apparatus and an adjustment part.

2. Related Art

Various liquid ejecting apparatuses capable of forming images by ejecting liquid onto a medium have been disclosed thus far. One such liquid ejecting apparatus includes a carriage, which holds a head capable of ejecting liquid onto a transported medium and which can move in an intersecting direction intersecting with the transport direction of the medium.

For example, JP-A-2015-67931 discloses an ink jet textile printing apparatus (liquid ejecting apparatus) including a carriage, which holds a head capable of ejecting ink (liquid) onto transported fabric (a medium) and which can move in an intersecting direction intersecting with the transport direction of the fabric.

However, in a typical liquid ejecting apparatus including a carriage, which holds a head capable of ejecting liquid onto a transported medium and which can move in an intersecting direction intersecting with the transport direction of the medium, airflow within the apparatus, produced by the carriage moving in the intersecting direction, has caused the ejection direction of the liquid to shift. As a result of diligent investigations on the part of the inventors, it was discovered that although airflow moving upstream in the transport direction and airflow moving downstream in the transport direction arise within the apparatus due to the carriage moving in the intersecting direction, it is easier for shifts to arise in the ejection direction of the liquid if there is a difference in the ease at which such airflow is generated.

Note that the ink jet textile printing apparatus of JP-A-2015-67931 includes a fan, and driving the fan makes it possible to suppress ink mist from sticking to the head. However, this configuration does not suppress shifting in the ejection direction of the liquid caused by airflow within the apparatus arising due to the movement of the carriage in the intersecting direction.

SUMMARY

Accordingly, an advantage of some aspects of the invention is to suppress shifting in the ejection direction of liquid.

To address the aforementioned issue, a liquid ejecting apparatus according to a first aspect of the invention including a head configured to eject liquid onto a medium transported in a transport direction, a carriage configured to hold the head and be movable in an intersecting direction intersecting with the transport direction, a support portion configured to support the medium from a side opposite the head, a frame portion provided upstream of the carriage in the transport direction, the carriage being attached to the frame portion, a cover portion configured to cover the carriage, a first adjustment part attached to the frame portion to protrude further toward the support portion side than a frame end portion, the frame end portion being an end portion of the frame portion located at the support portion side, and a second adjustment part that is, when a portion of the cover portion opposite the carriage downstream of the carriage in the transport direction is a downstream-side cover portion, is attached to the downstream-side cover portion to protrude further toward the support portion side than a cover end portion, the cover end portion being an end portion of the downstream-side cover portion located at the support portion side. A difference between a first adjustment distance being a gap between the first adjustment part and the support portion, and a second adjustment distance being a gap between the second adjustment part and the support portion, is smaller than a difference between a first distance being a gap between the frame end portion and the support portion, and a second distance being a gap between the cover end portion and the support portion.

According to this aspect, the difference between the first adjustment distance and the second adjustment distance is smaller than the difference between the first distance and the second distance. In other words, the first adjustment part and the second adjustment part are configured so that a difference in a gap at the support portion in the direction orthogonal to a surface of the support portion that supports the medium, between the upstream side and the downstream side with respect to the transport direction, is smaller. When the difference between the gap on the upstream side and the gap on the downstream side with respect to the transport direction is reduced, a difference in the ease with which airflow is generated between the upstream side and the downstream side with respect to the transport direction is less likely to arise. Shifting in the ejection direction of the liquid can therefore be suppressed.

A liquid ejecting apparatus according to a second aspect of the invention is the above-described first aspect, wherein the first adjustment distance and the second adjustment distance are equal.

According to this aspect, the first adjustment distance and the second adjustment distance are equal, and thus shifting in the ejection direction of the liquid can be effectively suppressed.

A liquid ejecting apparatus according to a third aspect of the invention is the liquid ejecting apparatus according to the above-described first or second aspect, including: a third adjustment part attached to the frame portion to protrude further toward the carriage side than the frame end portion, and a fourth adjustment part attached to the downstream-side cover portion to protrude further toward the carriage side than the downstream-side cover portion, wherein a difference between a third adjustment distance being a gap between the third adjustment part and the carriage, and a fourth adjustment distance being a gap between the fourth adjustment part and the carriage, is smaller than a difference between a third distance being a gap between the frame end portion and the carriage, and a fourth distance being a gap between the downstream-side cover portion and the carriage.

According to this aspect, the difference between the third adjustment distance and the fourth adjustment distance is smaller than the difference between the third distance and the fourth distance. In other words, not only is the configuration such that the first adjustment part and the second adjustment part reduce a difference in a gap at the support portion in the direction orthogonal to the surface of the support portion that supports the medium, between the upstream side and the downstream side with respect to the transport direction, but the configuration is also such that the third adjustment part and the fourth adjustment part reduce a difference in a gap in the transport direction, between the upstream side and the downstream side with respect to the transport direction. Shifting in the ejection direction of the liquid can therefore be effectively suppressed.

A liquid ejecting apparatus according to a fourth aspect of the invention is the above-described third aspect, wherein the third adjustment distance and the fourth adjustment distance are equal.

According to this aspect, the third adjustment distance and the fourth adjustment distance are equal, and thus shifting in the ejection direction of the liquid can be particularly effectively suppressed.

A liquid ejecting apparatus according to a fifth aspect of the invention is any one of the above-described first to fourth aspects, wherein a space reduction part configured to reduce a space between the cover portion and the carriage when viewed in the intersecting direction is attached to the carriage.

According to this aspect, the space reduction part, which reduces the space between the cover portion and the carriage when viewed in the intersecting direction, is attached to the carriage, and thus the space between the cover portion and the carriage is reduced. This makes it possible to reduce the actual generation of airflow caused by the movement of the carriage, and therefore makes it possible to effectively suppress shifts in the ejection direction of the liquid.

A liquid ejecting apparatus according to a sixth aspect of the invention is any one of the above-described first to fifth aspects, including a partition portion attached to the frame portion and protruding further toward a side opposite to the support portion side than the frame portion.

According to this aspect, the partition portion, which protrudes further toward a side opposite to the support portion side than the frame portion, is provided. Accordingly, the area of entrances and exits of airflow is reduced, which makes it possible to reduce the generation of airflow on the opposite side of the frame portion from the side on which the support portion is located, and makes it possible to effectively suppress shifts in the ejection direction of the liquid.

An adjustment part according to a seventh aspect of the invention is an adjustment part attachable to a liquid ejecting apparatus. The liquid ejecting apparatus including a head configured to eject liquid onto a medium transported in a transport direction, a carriage configured to hold the head and be movable in an intersecting direction intersecting with the transport direction, a support portion configured to support the medium from a side opposite the head, a frame portion provided upstream of the carriage in the transport direction, the carriage being attached to the frame portion, and a cover portion configured to cover the carriage. The adjustment part including a first adjustment part attached to the frame portion to protrude further toward the support portion side than a frame end portion, the frame end portion being an end portion of the frame portion located at the support portion side, and a second adjustment part that is, when a portion of the cover portion opposite the carriage downstream of the carriage in the transport direction is a downstream-side cover portion, is attached to the downstream-side cover portion to protrude further toward the support portion side than a cover end portion, the cover end portion being an end portion of the downstream-side cover portion located at the support portion side. The adjustment part can be attached to the liquid ejecting apparatus so that a difference between a first adjustment distance being a gap between the first adjustment part and the support portion, and a second adjustment distance being a gap between the second adjustment part and the support portion, is smaller than a difference between a first distance being a gap between the frame end portion and the support portion, and a second distance being a gap between the cover end portion and the support portion.

By attaching the adjustment part according to this aspect, the difference between the first adjustment distance and the second adjustment distance is smaller than the difference between the first distance and the second distance. In other words, the first adjustment part and the second adjustment part can reduce a difference in a gap at the support portion in the direction orthogonal to a surface of the support portion that supports the medium, between the upstream side and the downstream side with respect to the transport direction. Shifting in the ejection direction of the liquid can therefore be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a liquid ejecting apparatus according to examples of the invention will be described in detail with reference to the appended drawings.

EXAMPLE 1

Figure 1:
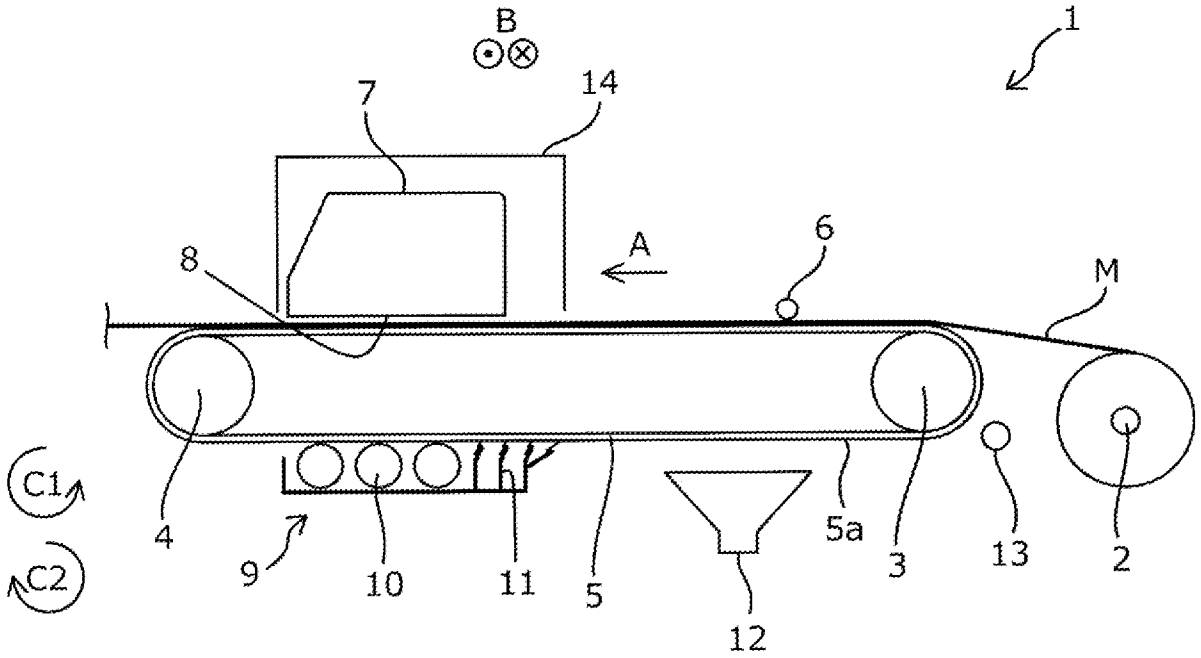
FIG. 1 is a schematic side view of a liquid ejecting apparatus according to Example 1 of the invention.
Figure 2:
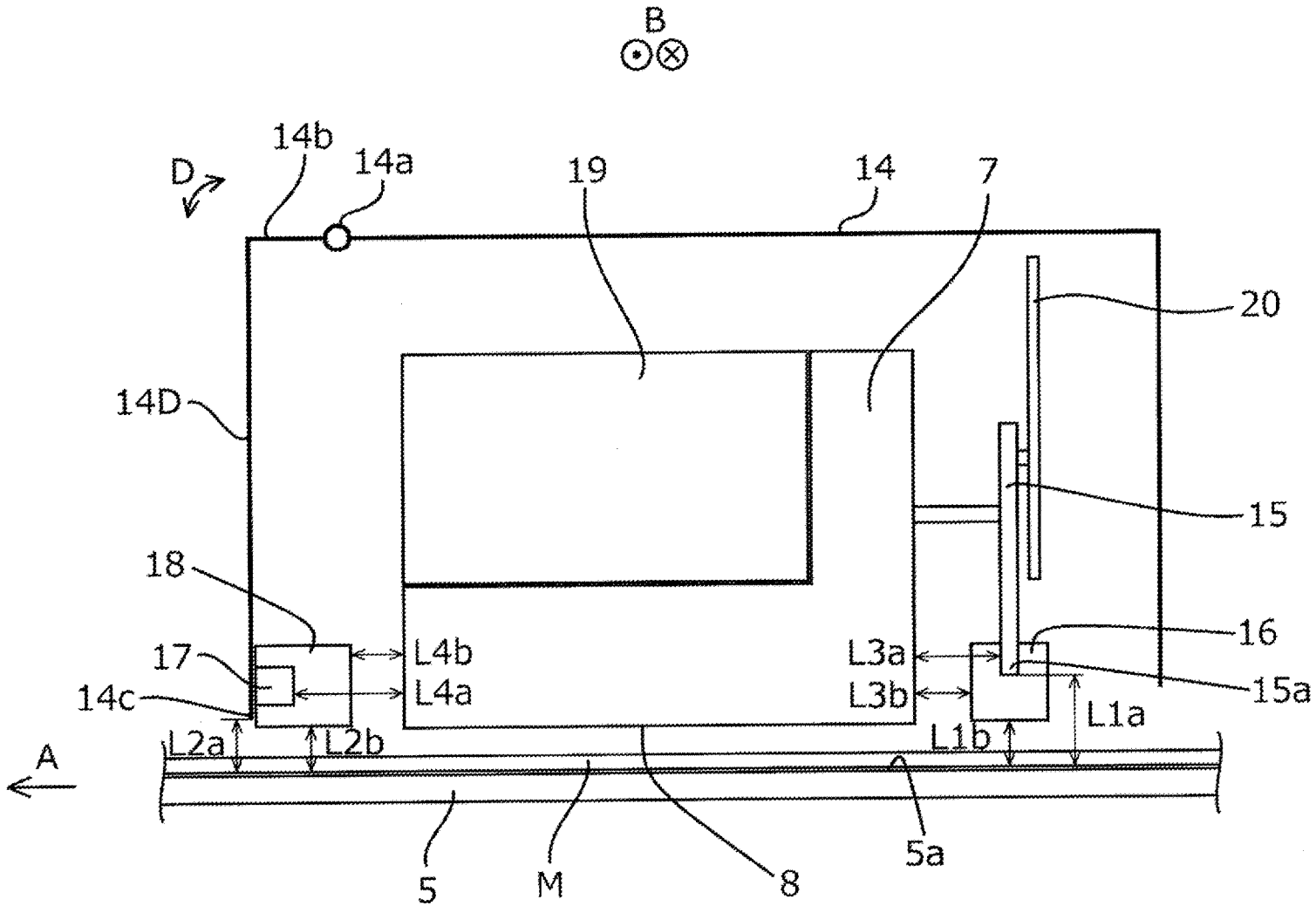
FIG. 2 is a schematic side view of primary elements of the liquid ejecting apparatus according to Example 1 of the invention.
Figure 3:
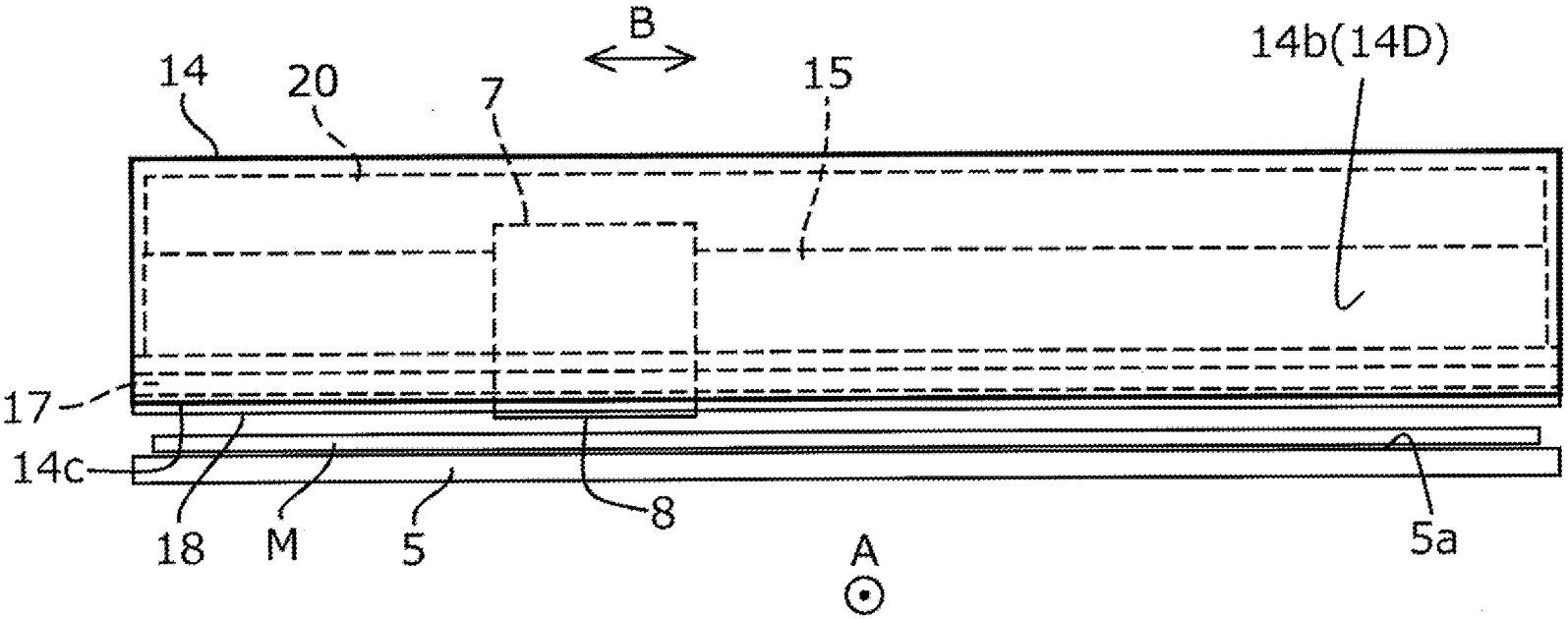
FIG. 3 is a schematic front view of primary elements of the liquid ejecting apparatus according to Example 1 of the invention.

See FIGS. 1 to 3

First, an overview of a liquid ejecting apparatus 1 according to Example 1 of the invention will be given.

FIG. 1 is a schematic view of the liquid ejecting apparatus 1 according to this example.

As illustrated in FIG. 1, the liquid ejecting apparatus 1 according to this example includes a set section 2 that sets a medium M, which is in roll form. The apparatus also includes a transport section capable of transporting the medium M, which has been fed out from the set section 2, in a transport direction A. The transport section includes a driven roller 3 located on an upstream side in the transport direction A, a driving roller 4 located on a downstream side in the transport direction A, and a transport belt 5, which is an endless belt stretched across the driven roller 3 and the driving roller 4.

Here, the transport belt 5 is an adhesive belt in which an adhesive has been applied to a support surface 5*a* (an outside surface), and as illustrated in FIG. 1, the medium M is supported and transported by the transport belt 5 in a state where the medium M has adhered to the outside surface to which the adhesive has been applied. In other words, the transport belt 5 is a support portion for the medium M. The region over which the transport belt 5 supports the medium M is the upper-side region stretched across the driven roller 3 and the driving roller 4. The driving roller 4 is a roller that rotates under driving force from a motor, which is not shown, and the driven roller 3 is a roller that rotates in response to the rotation of the transport belt 5 when the driving roller 4 is rotated. Although the support portion for the medium M is the transport belt 5 in this example, the configuration of the support portion is not particularly limited as long as the support portion is capable of supporting the medium M from a side opposite a head 8. For example, a flat plate-shaped platen, an adhesive drum, or the like may be used.

A carriage 7, which includes the head 8, is formed in the region over which the transport belt 5 supports the medium M, in a position opposite the transport belt 5, with the head 8 being capable of ejecting ink as liquid. The liquid ejecting apparatus 1 according to this example is capable of printing an image by ejecting ink from the head 8 onto the transported medium M while moving the carriage 7 back-and-forth in an intersecting direction B, which intersects with the transport direction A. By including the carriage 7 configured in this manner, the liquid ejecting apparatus 1 according to this example can form a desired image on the medium M by repeating the transport of the medium M in the transport direction A by a predetermined transport amount, and the ejection of the ink while moving the carriage 7 in the intersecting direction B while the medium M is stopped.

Additionally, the liquid ejecting apparatus 1 according to this example includes a cover portion 14 that covers the carriage 7. As illustrated in FIG. 1, the cover portion 14 is configured to cover substantially the entire carriage 7. Specifically, the cover portion 14 is configured to cover an upstream side of the carriage 7 with respect to the transport direction A, a downstream side of the carriage 7 with respect to the transport direction A, and the side of the carriage 7 opposite from the side on which the transport belt 5 is located. On the other hand, the side of the carriage 7 on which the transport belt 5 is located is not covered by the cover portion 14. In other words, the cover portion 14 does not completely cover the carriage 7.

The liquid ejecting apparatus 1 according to this example is what is known as a "serial printer", which carries out printing while repeating the transport of the medium M by a predetermined amount and scanning of the carriage 7 (back-and-forth movement in the intersecting direction B) in an alternating manner. In serial printers, airflow is generated within the cover portion 14 covering the carriage 7 due to the carriage 7 moving in the intersecting direction B. Such airflow may affect the ejection direction of the ink ejected from the head 8. Accordingly, the liquid ejecting apparatus 1 according to this example is configured to be capable of suppressing shifts in the ejection direction of the ink caused by such airflow (an airflow generation reduction configuration). The specific airflow generation reduction configuration will be described later.

Additionally, a medium affixing portion 6 is formed in a position opposite the transport belt 5, on the upstream side of the carriage 7 with respect to the transport direction A. The medium affixing portion 6 affixes the medium M to the transport belt 5, in a state where the generation of wrinkles and the like is suppressed, by pressing the medium M against the transport belt 5 across the width direction of the medium M (a direction corresponding to the intersecting direction B).

Upon being discharged from the liquid ejecting apparatus 1 according to this example, the medium M on which an image has been formed is fed to a drying apparatus (an apparatus that volatizes volatile components in the ink ejected onto the medium M), a winding apparatus (an apparatus that winds up the medium M on which the image has been formed), and the like provided in stages following the liquid ejecting apparatus 1 according to this example.

Here, a printable material is preferably used as the medium M. The term "printable material" refers to a fabric, a garment, and other clothing products which can be printed.

Fabrics includes natural fibers such as cotton, silk and wool, chemical fibers such as nylon, or composite fibers of natural fibers and chemical fibers such as woven cloths, knit fabrics, and non-woven cloths. Garments and other clothing products include sewn products, such as a T-shirt, handkerchief, scarf, towel, handbag, fabric bag, and furniture-related products including a curtain, sheet, and bed cover, as well as fabric before and after cutting to serve as pieces of cloth before sewing.

Furthermore, in addition to the printable material described above, the medium M may be special paper for ink-jet recording, such as plain paper, pure paper, or glossy paper. Other materials that can be used as the medium M include, for example, plastic films without a surface treatment applied to serve as an ink absorption layer for ink-jet printing, as well as substrates such as paper being applied a plastic coating and substrates being bonded a plastic film. Such plastic materials include, but are not limited to, for example, polyvinyl chloride, polyethylene terephthalate, polycarbonate, polystyrene, polyurethane, polyethylene, and polypropylene.

When a printable material is used as the medium M, it is easy for ink to seep through the printable material (a phenomenon where the ink ejected onto the medium M bleeds through to the rear surface of the medium), and there are therefore cases where the transport belt 5 is soiled by ink. Accordingly, the liquid ejecting apparatus 1 according to this example is provided with a cleaning section 9 configured to clean ink that has seeped through and remains on the transport belt 5. The cleaning section 9 according to this example includes three cleaning brushes 10, which are immersed in a cleaning liquid and make contact with the transport belt 5, and four wipers 11, which wipe off cleaning liquid that has adhered to the transport belt 5 as a result of the cleaning brushes 10 making contact with the transport belt 5. Additionally, the cleaning section 9 according to this example is configured to be capable of moving away from the transport belt 5.

Furthermore, the liquid ejecting apparatus 1 according to this example includes a drying section capable of drying cleaning liquid that could not be completely wiped off by the wipers 11. The drying section includes a heating portion 12 that heats the transport belt 5, and a blowing portion 13 that blows air onto the transport belt 5.

The liquid ejecting apparatus 1 according to this example is capable of transporting the medium M in the transport direction A by rotating the driving roller 4 in a rotation direction C1, but is also capable of transporting the medium M in reverse, i.e., in the direction opposite from the transport direction A, by rotating the driving roller 4 in a rotation direction C2, which is the opposite direction from the rotation direction C1. Note that the liquid ejecting apparatus 1 according to this example can not only rotate the driving roller 4 in the rotation direction C1 and the rotation direction C2 in a state where the medium M is supported by the transport belt 5, but can also rotate the driving roller 4 in the rotation direction C1 and the rotation direction C2 in a state where the medium M is not supported by the transport belt 5.

The airflow generation reduction configuration of the liquid ejecting apparatus 1 according to this example will be described next.

FIG. 2 is a schematic side view illustrating the internal configuration of the cover portion 14, which is a primary element of the liquid ejecting apparatus 1 according to this example. FIG. 3 is a schematic front view illustrating the internal configuration of the cover portion 14 in the liquid ejecting apparatus 1 according to this example.

As described above, the liquid ejecting apparatus 1 according to this example includes the cover portion 14, and as illustrated in FIG. 2, the cover portion 14 includes a front cover 14*b* that opens and closes by pivoting in a pivot direction D central to a rotary shaft 14*a*. At this time, an end portion of the front cover 14*b* on the support portion side (an end portion on the side where the transport belt 5 is located) is called a cover end portion 14*c*. A positioning portion 17, which contacts the front cover 14*b* when the front cover 14*b* is closed (positions the front cover 14*b* in a closed position by contacting the front cover 14*b*), is provided in the cover portion 14. At this time, the cover end portion 14*c* of the front cover 14*b* contacts the positioning portion.

Here, the portions of the cover portion 14 located opposite the carriage 7 on the downstream side of the carriage 7 with respect to the transport direction A will be collectively referred to as "downstream-side cover portions 14D". At this time, the downstream-side cover portions 14D are configured including the front cover 14*b* and the positioning portion 17. Note that the cover portion 14 need not be provided with an opening/closing mechanism. If the cover portion 14 is not provided with the opening/closing mechanism, the positioning portion 17 also need not be provided.

A frame portion 15, which extends in the intersecting direction B, is provided within the cover portion 14, on the upstream side of the carriage 7 with respect to the transport direction A. The configuration is such that the carriage 7 is attached to the frame portion 15, and is capable of moving in the intersecting direction B relative to the frame portion 15 within the cover portion 14.

Here, as illustrated in FIG. 2, a first adjustment part 16 is attached to the frame portion 15 to protrude further toward the support portion than a frame end portion 15*a*, which is an end portion of the frame portion 15 on the support portion side. By attaching the first adjustment part 16 to the frame portion 15, a first adjustment distance Lib, which is a gap between the first adjustment part 16 and the transport belt 5 (a distance in a direction orthogonal to the support surface 5*a*), is shorter than a first distance L1*a*, which is a gap between the frame end portion 15*a* and the transport belt 5 (a distance in the direction orthogonal to the support surface 5*a*). When the gaps relative to the transport belt 5 in the internal space of the cover portion 14, on the upstream and downstream sides with respect to the transport direction A, are made short, entrances and exits for airflow become smaller, which makes it possible to reduce the generation of airflow when the carriage 7 moves in the intersecting direction B. In other words, by attaching the first adjustment part 16 to the frame portion 15, the liquid ejecting apparatus 1 according to this example reduces a gap in the internal space of the cover portion 14 on the downstream side with respect to the transport direction A, and reduces the generation of airflow.

Additionally, as illustrated in FIGS. 2 and 3, a second adjustment part 18 is attached to the positioning portion 17 (the downstream-side cover portions 14D), to protrude further toward the support portion than the cover end portion 14*c*, which is the end portion of the front cover 14*b* on the support portion side. By attaching the second adjustment part 18 to the positioning portion 17, a second adjustment distance L2*b*, which is a gap between the second adjustment part 18 and the transport belt 5 (a distance in the direction orthogonal to the support surface 5*a*), is shorter than a second distance L2*a*, which is a gap between the cover end portion 14*c* and the transport belt 5 (a distance in the direction orthogonal to the support surface 5*a*). In other words, by attaching the second adjustment part 18 to the positioning portion 17, the liquid ejecting apparatus 1 according to this example reduces a gap in the internal space of the cover portion 14 on the upstream side with respect to the transport direction A, and reduces the generation of airflow. Note that the second adjustment part 18 may be attached to any of the downstream-side cover portions 14D, and the configuration may be such that, for example, the second adjustment part 18 is attached to the front cover 14*b*.

Attaching the first adjustment part 16 to the frame portion 15 and furthermore attaching the second adjustment part 18 to the positioning portion 17 makes the first adjustment distance L1*b* equal to the second adjustment distance L2*b*, which reduces the difference in the gap, relative to the transport belt 5, between the upstream side and the downstream side with respect to the transport direction A, in the internal space of the cover portion 14. Employing such a configuration reduces variations in the degree to which airflow is generated between the upstream side and the downstream side in the internal space of the cover portion 14, with respect to the transport direction A, and suppresses shifting in the ejection direction of the ink ejected from the head 8.

In sum, the liquid ejecting apparatus 1 according to this example includes the head 8, which is capable of ejecting ink serving as liquid onto the medium M transported in the transport direction A, and the carriage 7, which holds the head 8 and is capable of moving in the intersecting direction B intersecting with the transport direction A. The apparatus further includes the transport belt 5, which is capable of supporting the medium M from the side opposite from the side on which the head 8 is located, the frame portion 15, which is provided on the upstream side of the carriage 7 with respect to the transport direction A and to which the carriage 7 is attached, and the cover portion 14, which covers the carriage 7. The apparatus further includes the first adjustment part 16, which is attached to the frame portion 15 to protrude further toward the support portion than the frame end portion 15*a*, which is an end portion of the frame portion 15 on the support portion side, and the second adjustment part 18 which, when the parts of the cover portion 14 opposite the carriage 7 on the downstream side of the carriage 7 with respect to the transport direction A are taken as the downstream-side cover portions 14D, is attached to the downstream-side cover portions 14D to protrude further toward the support portion than the cover end portion 14*c*, which is an end portion of the downstream-side cover portions 14D on the support portion side. A difference between the first adjustment distance L1*b*, which is a gap between the first adjustment part 16 and the transport belt 5, and the second adjustment distance L2*b*, which is a gap between the second adjustment part 18 and the transport belt 5 (L1*b*-L2*b*), is smaller than a difference between the first distance L1*a*, which is a gap between the frame end portion 15*a* and the transport belt 5, and the second distance L2*a*, which is a gap between the cover end portion 14*c* and the transport belt 5 (L1*a*-L2*a*).

In other words, the liquid ejecting apparatus 1 according to this example is configured so that the first adjustment part 16 and the second adjustment part 18 reduce a difference in a gap in the direction orthogonal to the support surface 5*a* (the direction in which the head 8 and the transport belt 5 oppose each other), between the upstream side and the downstream side with respect to the transport direction A. When the difference between the gap on the upstream side and the gap on the downstream side with respect to the transport direction A is reduced, a difference in the ease with which airflow is generated between the upstream side and the downstream side with respect to the transport direction A is less likely to arise. Accordingly, the liquid ejecting apparatus 1 according to this example suppresses shifts in the ejection direction of the ink.

To describe from a different standpoint, the adjustment parts according to this example (the first adjustment part 16 and the second adjustment part 18) are adjustment parts that can be attached to the liquid ejecting apparatus 1, the liquid ejecting apparatus 1 including the head 8 capable of ejecting liquid onto the medium M transported in the transport direction A, the carriage 7 that holds the head 8, the carriage 7 being capable of moving in the intersecting direction B that intersects with the transport direction A, the transport belt 5 capable of supporting the medium M from a side opposite the head 8, the frame portion 15, provided on an upstream side of the carriage 7 with respect to the transport direction A, the carriage 7 being attached to the frame portion 15, and the cover portion 14 that covers the carriage 7. The adjustment parts according to this example include the first adjustment part 16, which is attached to the frame portion 15 to protrude further toward the support portion than the frame end portion 15*a*, which is an end portion of the frame portion 15 on the support portion side, and the second adjustment part 18 which, when the portions of the cover portion 14 opposite the carriage 7 on the downstream side of the carriage 7 with respect to the transport direction A (the front cover 14*b* and the positioning portion 17) are taken as the downstream-side cover portions 14D, is attached to the downstream-side cover portions 14D to protrude further toward the support portion than the cover end portion 14*c*, which is an end portion of the downstream-side cover portions 14D on the support portion side. The adjustment parts according to this example can be attached to the liquid ejecting apparatus 1 so that a difference between the first adjustment distance L1*b*, which is a gap between the first adjustment part 16 and the transport belt 5, and the second adjustment distance L2*b*, which is a gap between the second adjustment part 18 and the transport belt 5, is smaller than a difference between the first distance L1*a*, which is a gap between the frame end portion 15*a* and the transport belt 5, and the second distance L2*a*, which is a gap between the cover end portion 14*c* and the transport belt 5. In other words, the first adjustment part 16 and the second adjustment part 18 are configured having shapes and sizes with which the difference between the first adjustment distance L1*b* and the second adjustment distance L2*b* is smaller than the difference between the first distance L1*a* and the second distance L2*a*.

That is, with the adjustment parts according to this example, the first adjustment part 16 and the second adjustment part 18 reduce a difference in a gap in the direction orthogonal to the support surface 5*a*, between the upstream side and the downstream side with respect to the transport direction A. Shifting in the ejection direction of the ink can therefore be suppressed.

Additionally, as described above, in the liquid ejecting apparatus 1 according to this example, the first adjustment distance L1*b* and the second adjustment distance L2*b* are equal. Accordingly, the liquid ejecting apparatus 1 according to this example is configured to be capable of effectively suppressing a shift in the ejection direction of the ink. Note that although it is preferable that the first adjustment distance L1*b* and the second adjustment distance L2*b* be equal, these distances do not absolutely have to be equal. There may be a slight difference between the first adjustment distance L1*b* and the second adjustment distance L2*b*, as long as the difference between the first adjustment distance L1*b* and the second adjustment distance L2*b* is not extremely large.

Here, as illustrated in FIG. 2, attaching the first adjustment part 16 to the frame portion 15 makes a third adjustment distance L3*b*, which is a gap between the first adjustment part 16 and the carriage 7 (a distance in the transport direction A), shorter than a third distance L3*a*, which is a gap between the frame end portion 15*a* and the carriage 7 (a distance in the transport direction A). When the gaps relative to the carriage 7 in the internal space of the cover portion 14, with respect to the transport direction A, are made short, entrances and exits for airflow become smaller, which makes it possible to reduce the generation of airflow when the carriage 7 moves in the intersecting direction B. In other words, by attaching the first adjustment part 16 to the frame portion 15, the liquid ejecting apparatus 1 according to this example reduces a gap with the carriage 7 with respect to the transport direction A, in the internal space of the cover portion 14, and reduces the generation of airflow. Note that in this example, it can be said that the first adjustment part 16 also serves as a third adjustment part that reduces the gap relative to the carriage 7, with respect to the transport direction A, in the internal space of the cover portion 14. However, the third adjustment part that reduces the gap relative to the carriage 7, with respect to the transport direction A, in the internal space of the cover portion 14 may be formed as a constituent element separate from the first adjustment part 16. Forming the third adjustment part as a constituent element separate from the first adjustment part 16 makes it possible to adjust the third adjustment distance L3*b* and the first adjustment distance L1*b* independently.

Additionally, as illustrated in FIG. 2, attaching the second adjustment part 18 to the positioning portion 17 (the downstream-side cover portions 14D) makes a fourth adjustment distance L4*b*, which is a gap between the second adjustment part 18 and the carriage 7 (a distance in the transport direction A), shorter than a fourth distance L4*a*, which is a gap between the positioning portion 17 and the carriage 7 (a distance in the transport direction A). In other words, by attaching the second adjustment part 18 to the positioning portion 17, the liquid ejecting apparatus 1 according to this example reduces a gap with the carriage 7 with respect to the transport direction A, in the internal space of the cover portion 14, and reduces the generation of airflow. Note that in this example, it can be said that the second adjustment part 18 also serves as a fourth adjustment part that reduces the gap relative to the carriage 7, with respect to the transport direction A, in the internal space of the cover portion 14. However, the fourth adjustment part that reduces the gap relative to the carriage 7, with respect to the transport direction A, in the internal space of the cover portion 14 may be formed as a constituent element separate from the second adjustment part 18. Forming the fourth adjustment part as a constituent element separate from the second adjustment part 18 makes it possible to adjust the fourth adjustment distance L4*b* and the second adjustment distance L2*b* independently. Note that the fourth adjustment part may be attached to any of the downstream-side cover portions 14D, and the configuration may be such that, for example, the fourth adjustment part is attached to the front cover 14*b*.

Attaching the first adjustment part 16 to the frame portion 15 and furthermore attaching the second adjustment part 18 to the positioning portion 17 makes the third adjustment distance L3*b*, equal to the fourth adjustment distance L4*b*, which reduces the difference in the gap, relative to the carriage 7, between the upstream side and the downstream side with respect to the transport direction A, in the internal space of the cover portion 14. Employing such a configuration reduces variations in the degree to which airflow is generated between the upstream side and the downstream side in the internal space of the cover portion 14, with respect to the transport direction A, and suppresses shifting in the ejection direction of the ink ejected from the head 8.

In other words, the liquid ejecting apparatus 1 of this example includes the third adjustment part, which is attached to the frame portion 15 to protrude further toward the carriage 7 than the frame end portion 15*a* (in this example, the first adjustment part 16 also functions as the third adjustment part), and the fourth adjustment part, which is attached to the downstream-side cover portions 14D to protrude further toward the carriage 7 than the downstream-side cover portions 14D (the positioning portion 17) (in this example, the second adjustment part 18 also functions as the fourth adjustment part). A difference between the third adjustment distance L3*b*, which is a gap between the first adjustment part 16 and the carriage 7, and the fourth adjustment distance L4*b*, which is a gap between the second adjustment part 18 and the carriage 7 (L3*b*-L4*b*), is smaller than a difference between the third distance L3*a*, which is a gap between the frame end portion 15*a* and the carriage 7, and the fourth distance L4*a*, which is a gap between the downstream-side cover portions 14D and the carriage 7 (L3*a*-L4*a*).

In other words, the liquid ejecting apparatus 1 according to this example is not only configured so that the first adjustment part 16 and the second adjustment part 18 reduce a difference in a gap in the direction orthogonal to the support surface 5*a*, between the upstream side and the downstream side with respect to the transport direction A, but is also configured so that the first adjustment part 16, which also functions as the third adjustment part, and the second adjustment part 18, which also functions as the fourth adjustment part, reduce a difference in a gap in the transport direction A, between the upstream side and the downstream side with respect to the transport direction A. Accordingly, the liquid ejecting apparatus 1 according to this example is configured to be capable of effectively suppressing a shift in the ejection direction of the ink.

Additionally, as described above, in the liquid ejecting apparatus 1 according to this example, the third adjustment distance L3*b* and the fourth adjustment distance L4*b* are equal. Accordingly, the liquid ejecting apparatus 1 according to this example is configured to be particularly capable of effectively suppressing a shift in the ejection direction of the ink. Note that although it is preferable that the third adjustment distance L3*b* and the fourth adjustment distance L4*b* be equal, these distances do not absolutely have to be equal. There may be a slight difference between the third adjustment distance L3*b* and the fourth adjustment distance L4*b*, as long as the difference between the third adjustment distance L3*b* and the fourth adjustment distance L4*b* is not extremely large.

Additionally, as illustrated in FIG. 2, in the liquid ejecting apparatus 1 according to this example, a space reduction part 19 that reduces a space between the cover portion 14 and the carriage 7 as viewed from the intersecting direction B (increases the bulk of the carriage 7) is attached to the carriage 7. Accordingly, the liquid ejecting apparatus 1 according to this example has a configuration that, by reducing the space between the cover portion 14 and the carriage 7, can reduce the actual generation of airflow caused by the movement of the carriage 7, and can therefore effectively suppress shifts in the ejection direction of the ink. Note that the space reduction part 19 is preferably configured to be as lightweight as possible. This is because the space reduction part 19 being heavy risks inhibiting the movement of the carriage 7. The space reduction part 19 can be given a lightweight configuration by forming the part to be hollow inside, forming the part of a resin member, or the like, for example.

Additionally, as illustrated in FIG. 2, the liquid ejecting apparatus 1 according to this example includes a partition portion 20, which is attached to the frame portion 15 and protrudes further in the direction away from the transport belt 5 (toward the cover portion 14) than the frame portion 15. Accordingly, the liquid ejecting apparatus 1 of this example is configured so that the area of entrances and exits of airflow is reduced, which makes it possible to reduce the generation of airflow on the opposite side of the frame portion 15 from the side on which the transport belt 5 is located, and makes it possible to effectively suppress shifts in the ejection direction of the ink. Note that although the partition portion 20 protrudes so that a predetermined gap is present between the partition portion 20 and the cover portion 14, it is preferable that this gap be as small as possible. This is because a smaller gap makes it possible to reduce the area of entrances and exits of airflow. For example, the partition portion 20 may protrude far enough to contact the cover portion 14.

EXAMPLE 2

FIG. 4

A liquid ejecting apparatus 1 according to Example 2 will be described next.

Figure 4:
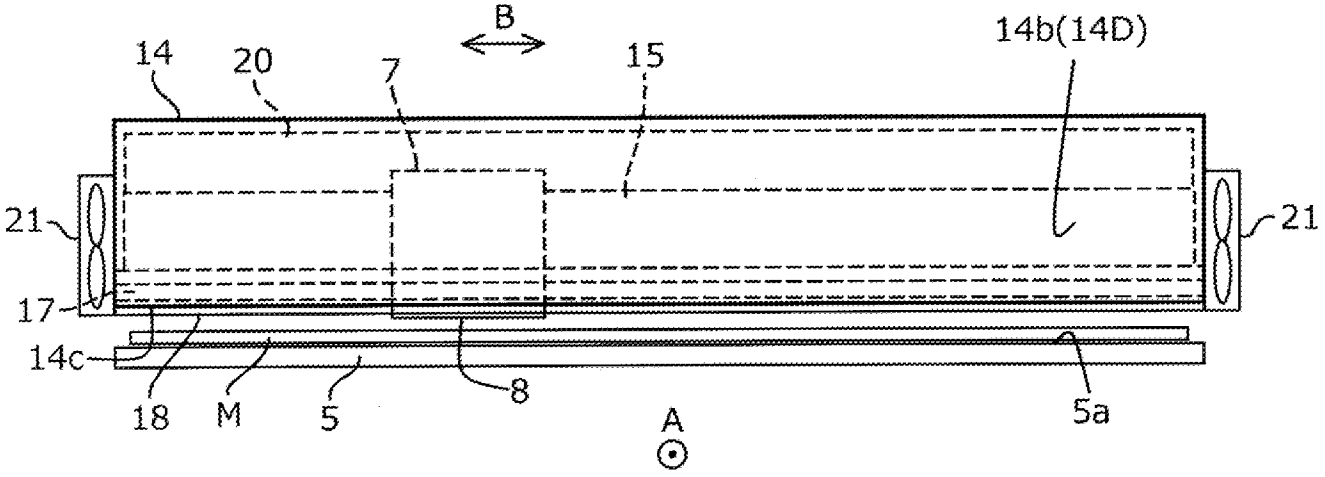
FIG. 4 is a schematic front view of primary elements of a liquid ejecting apparatus according to Example 2 of the invention.

FIG. 4 is a schematic front view illustrating the internal configuration of the cover portion 14 in the liquid ejecting apparatus 1 according to this example, and is a diagram corresponding to FIG. 3, which illustrates the liquid ejecting apparatus 1 according to Example 1. Like numbers designate identical or corresponding component elements in Example 1, described above, and detailed description for such component elements are omitted.

Here, aside from including fans 21, the liquid ejecting apparatus 1 according to this example is the same configuration as the liquid ejecting apparatus 1 according to Example 1.

As illustrated in FIG. 4, the liquid ejecting apparatus 1 according to this example includes the fan 21, one at each end of the cover portion 14 with respect to the intersecting direction B. The configuration is such that the fans 21 can be driven in tandem with the scanning of the carriage 7 (the back-and-forth movement in the intersecting direction B) to reduce the generation of airflow caused by the scanning of the carriage 7. Specifically, the fans 21 are driven in tandem with the scanning of the carriage 7 (the back-and-forth movement in the intersecting direction B) to generate airflow acting as following wind with respect to the moving carriage 7. Accordingly, the liquid ejecting apparatus 1 of this example is configured to be particularly capable of effectively suppressing a shift in the ejection direction of the ink.

Note that the invention is not intended to be limited to the aforementioned examples, and many variations are possible within the scope of the invention as described in the appended claims. It goes without saying that such variations also fall within the scope of the invention. For example, the adjustment parts may be divided into five or more parts.

This application claims priority under 35 U.S.C. § 119 to Japanese Patent Application No. 2018-045548, filed Mar. 13, 2018. The entire disclosure of Japanese Patent Application No. 2018-045548 is hereby incorporated herein by reference.

What is claimed is:

1. A liquid ejecting apparatus comprising:

a head configured to eject liquid onto a medium transported in a transport direction;

a carriage configured to hold the head and be movable in an intersecting direction intersecting with the transport direction;

a support portion configured to support the medium from a side opposite the head;

a frame portion provided upstream of the carriage in the transport direction, the carriage being attached to the frame portion;

a cover portion configured to cover the carriage;

a first adjustment part attached to the frame portion to protrude further toward the support portion side than a frame end portion, the frame end portion being an end portion of the frame portion located at the support portion side; and a second adjustment part that, when a portion of the cover portion opposite the carriage downstream of the carriage in the transport direction is a downstream-side cover portion, is attached to the downstream-side cover portion to protrude further toward the support portion side than a cover end portion, the cover end portion being an end portion of the downstream-side cover portion located at the support portion side, wherein a difference between a first adjustment distance being a gap between the first adjustment part and the support portion, and a second adjustment distance being a gap between the second adjustment part and the support portion, is smaller than a difference between a first distance being a gap between the frame end portion and the support portion, and a second distance being a gap between the cover end portion and the support portion.

2. The liquid ejecting apparatus according to claim 1, wherein the first adjustment distance and the second adjustment distance are equal.

3. The liquid ejecting apparatus according to claim 1, further comprising:

a third adjustment part attached to the frame portion to protrude further toward the carriage side than the frame end portion; and a fourth adjustment part attached to the downstream-side cover portion to protrude further toward the carriage side than the downstream-side cover portion, wherein a difference between a third adjustment distance being a gap between the third adjustment part and the carriage, and a fourth adjustment distance being a gap between the fourth adjustment part and the carriage, is smaller than a difference between a third distance being a gap between the frame end portion and the carriage, and a fourth distance being a gap between the downstream-side cover portion and the carriage.

4. The liquid ejecting apparatus according to claim 3, wherein the third adjustment distance and the fourth adjustment distance are equal.

5. The liquid ejecting apparatus according to claim 1, wherein a space reduction part configured to reduce a space between the cover portion and the carriage when viewed in the intersecting direction is attached to the carriage.

6. The liquid ejecting apparatus according to claim 1, further comprising:

a partition portion attached to the frame portion and protruding further toward a side opposite to the support portion side than the frame portion.

7. An adjustment part attachable to a liquid ejecting apparatus, the liquid ejecting apparatus comprising:

a head configured to eject liquid onto a medium transported in a transport direction, a carriage configured to hold the head and be movable in an intersecting direction intersecting with the transport direction;

a support portion configured to support the medium from a side opposite the head;

a frame portion provided upstream of the carriage in the transport direction, the carriage being attached to the frame portion; and a cover portion configured to cover the carriage, the adjustment part comprising:

a first adjustment part attached to the frame portion to protrude further toward the support portion side than a frame end portion, the frame end portion being an end portion of the frame portion located at the support portion side; and a second adjustment part that, when a portion of the cover portion opposite the carriage downstream of the carriage in the transport direction is a downstream-side cover portion, is attached to the downstream-side cover portion to protrude further toward the support portion side than a cover end portion, the cover end portion being an end portion of the downstream-side cover portion located at the support portion side, wherein the adjustment part is attachable to the liquid ejecting apparatus so that a difference between a first adjustment distance being a gap between the first adjustment part and the support portion, and a second adjustment distance being a gap between the second adjustment part and the support portion, is smaller than a difference between a first distance being a gap between the frame end portion and the support portion, and a second distance being a gap between the cover end portion and the support portion.

* * * * *